United States Patent [19]

Lind

[11] 3,935,008

[45] Jan. 27, 1976

[54] ELECTROPHOTOGRAPHIC PROCESS HAVING DEVELOPED HYDROPHILIC IMAGE AREAS

[75] Inventor: Erwin Lind, Auringen, Germany

[73] Assignee: Hoechst Aktiengesellschaft, Frankfurt, Germany

[22] Filed: June 21, 1973

[21] Appl. No.: 372,239

[30] Foreign Application Priority Data

June 23, 1972 Germany ..... 2230757

[52] U.S. Cl. ..... 96/1.4; 96/1 LY

[51] Int. Cl.[2] ..... G03G 13/14

[58] Field of Search..... 96/1.4, 1.5, 1 R, 1 SD, 96/1 LY; 117/37, 17.5

[56] References Cited

UNITED STATES PATENTS

| | | | |
|---|---|---|---|
| 2,297,691 | 10/1942 | Carlson | 96/1.4 |
| 3,157,546 | 11/1964 | Cover | 96/1.4 |
| 3,287,121 | 11/1966 | Hoegl | 96/1.5 |
| 3,386,822 | 6/1968 | Brynko | 96/1.4 |

*Primary Examiner*—Norman G. Torchin
*Assistant Examiner*—John L. Goodrow
*Attorney, Agent, or Firm*—Stevens, Davis, Miller & Mosher

[57] ABSTRACT

A process for the production of a copy from an original which includes creating a charge image on a hydrophobic photoconductive material, pre-developing the charge image by the application thereto of a hydrophilic solid substance, meniscally contacting the pre-developed image with an aqueous liquid and transferring the image onto a copy receiving material. The hydrophobic photoconductive material may be a charge transfer complex of polyvinyl carbazole and trinitrofluorenone. The hydrophilic solid substance may be water-insoluble starch, silica, iron-III-oxide, zinc oxide, methylene blue, nigrosin or acid violet.

15 Claims, 1 Drawing Figure

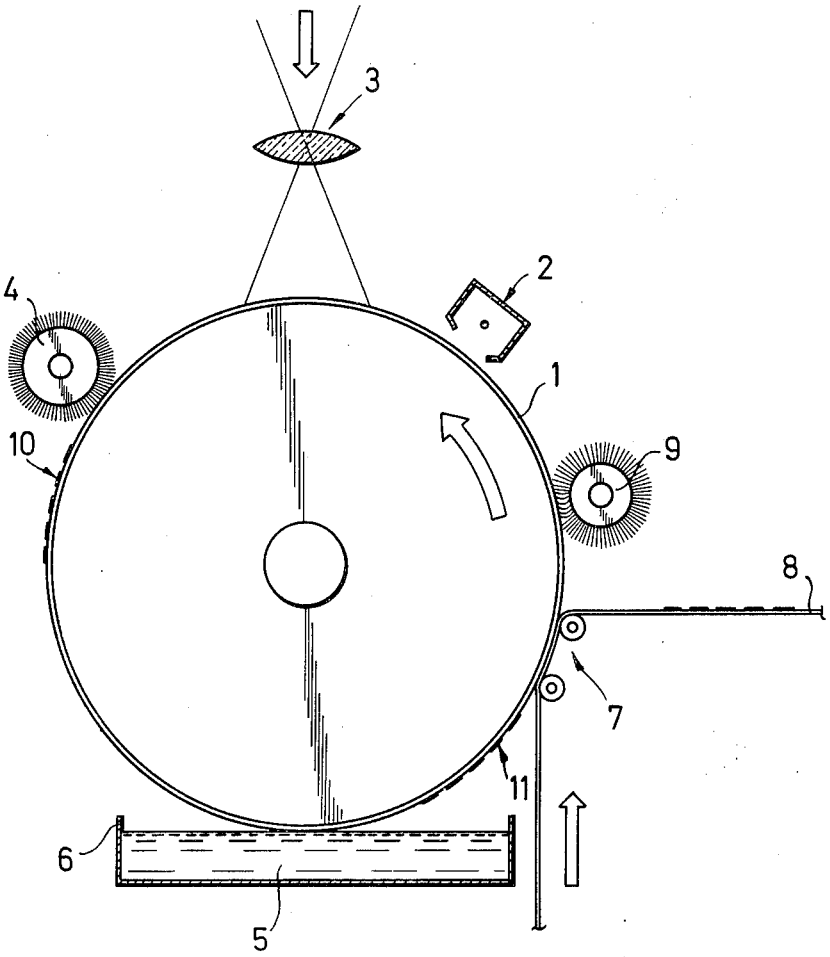
3
2
4
1
10
9
8
7
11
6
5

ELECTROPHOTOGRAPHIC PROCESS HAVING DEVELOPED HYDROPHILIC IMAGE AREAS

The present invention relates to a process for the production of a copy from an original wherein a charge image corresponding to the original is produced, the charge image is made visible by means of a developer, and is then transferred onto a copy receiving material.

Processes of this type have been described in many different variations within recent years, and these electrophotographic reproduction processes have gained great technical importance.

In what is probably the best known electrophotographic process, a two-component developer is used. Development is accomplished in a manner such that the toner component of the two-component developer adheres to the charged areas of the image. The toner image is then transferred onto a copy receiving material, preferably paper. The image made up of thermoplastic toner material must be fixed in order to render it fast to wiping. For this purpose, heat radiators, hot-air blowers and similar devices may be used. The fixing devices constitute a serious problem in electrophotographic reproduction techniques, because they have a very high energy consumption.

In another process, which has been recently proposed but not yet published, the development of the charge image present on the photoconductor is performed with the aid of tiny droplets of a tacky liquid suspended in a highly insulating liquid organic carrier.

Although this process yields excellent copies and eliminates the need for a fixing step requiring a high power input, it has the essential drawback that the liquid developer consists substantially of an organic solvent, such as "Isopar G" (a commercial product marketed by the Humble Oil and Refining Corporation, New York, N.Y., USA), and that a certain quantity of this organic solvent inevitably escapes into the surrounding air.

Finally, an electrophotographic process is known in which the charge image is developed by a so-called "ink-development". Despite its indisputable advantages, this process did not gain large-scale acceptance, because it involves the use of special recording materials.

It is the object of the present invention to provide an electrophotographic process which uses a re-usable photoconductor and plain paper as the recording material and which eliminates the fixing problems as well as the difficulties connected with organic liquid developers.

According to the present invention, this object is achieved by a process which is characterized in that the charge image is produced, in a manner known per se, on a hydrophobic material, especially a photoconductor layer, that the charge image is then pre-developed by means of a hydrophilic solid substance, that the pre-developed image is then treated with an aqueous liquid, and that the image thus produced is finally transferred onto a copy receiving material.

Suitable hydrophilic solid substances for pre-development are inorganic pigments, especially zinc oxide, iron-III-oxide and silica, or organic hydrophilic substances, especially starch or polyvinyl alcohol and water-soluble dyestuffs, especially methylene blue, nigrosin, or acid violet. The dyestuff may also be adsorbed by a hydrophilic carrier, for example precipitated silica. Suitable hydrophilic solid substances may be prepared by hydrophilizing the solid substances, e.g. by treatment with wetting agents. Suitable wetting solutions are colored aqueous solutions, e.g. aqueous solutions of organic dyestuffs, such as crystal violet or methylene blue solutions. If the hydrophilic solid substance itself effects a coloration, it may be sufficient to use only water for development.

Suitable hydrophobic supports for the charge image are organic photoconductors, such as oxadiazoles (German Pat. No. 1,058,836), triazoles (German Pat. No. 1,060,260), oxazoles (German Pat. No. 1,120,875), benzthiazoles (German Pat. No. 1,137,025), polyvinyl carbazole (German Pat. No. 1,111,935), aniline-formaldehyde condensate (German Pat. No. 1,197,325), bromopyrene resin or selenium. Advantageously, hydrophobic binders are added during the preparation of the photoconductor layers. In order to improve their hydrophobic characteristics, the photoconductor layers may subsequently be provided with a thin hydrophobic top layer, preferably a layer of polymethyl siloxanes or polymeric fluorinated hydrocarbons, e.g., polytetrahydroperfluoro-alkyl acrylate.

By the process of the present invention, it is possible, for the first time, to apply an aqueous developing process to a charge image on a reusable photoconductor and to transfer the image onto plain paper. The degree of sizing or beating of the paper should not be too high, so that it readily accepts the aqueous image. On the other hand, the paper must not be unduly absorptive, because otherwise the image may tend to "run".

The present invention will now be described in detail by reference to the following non-limiting examples and to the attached drawing.

The single FIGURE of the drawing shows a diagrammatic section of an electrophotographic reproduction apparatus. A photoconductor 1 is stretched over a drum and is uniformly charged by means of a corona 2, then image-wise exposed in an exposure station 3, and pre-developed in a developing station 4. For pre-development, a two-component developer mixture consisting of magnetizable iron filings and one of the hydrophilic solid substances used in the examples is applied to the charge image by means of a magnet brush.

In this manner, a very weak, scarcely visible image 10 consisting of the hydrophilic solid substance is produced on the photoconductor 1. This pre-developed image 10 is then treated with an aqueous liquid 5 stored in a trough 6, which is in meniscal contact with the pre-developed photoconductor. Of course, the liquid may be applied by any other known method. At this stage of the process, the aqueous liquid 5 reaches only the image areas 10 which have already been pre-developed with the hydrophilic substance, whereas it is repelled by the hydrophobic photoconductor 1. In this manner, an aqueous image 11 is produced on the photoconductor. In the transfer station 7, this aqueous image 11 is transferred onto a copy receiving material 8, preferably paper. Finally, in the cleaning station 9, any traces of hydrophilic solid substance 10 still adhering to the photoconductor are removed. This cleaning is particularly easy when the hydrophilic substance is a magnetizable material. In this case, cleaning may be performed simply by using a magnet.

The inventive process now will be described in more detail by reference to the following examples:

EXAMPLE 1

A photoconductor (polyvinyl carbazole/trinitrofluorenone film) was uniformly charged and image-wise exposed. The resulting charge image was developed by means of a magnet brush containing iron filings as the carrier particles. The iron filings were mixed with a small portion (approx. 1 percent by weight) of zinc oxide powder. After this treatment, an image-wise distributed thin layer of zinc oxide powder became visible on the photoconductor. This image was then treated with a 0.1 percent solution of crystal violet by immersing the photoconductor film in the wetting solution. The crystal violet solution deposited or collected in the areas of the photoconductor layer which carried the zinc oxide layer. The image thus produced was then transferred onto paper.

EXAMPLE 2

The method used in Example 1 was repeated, except that iron-III-oxide was used instead of zinc oxide. The image produced was approximately of the same quality as that obtained by the method described in Example 1.

EXAMPLE 3

The procedure described in Example 1 was repeated, using precipitated silica ("Quso H 40", a commercial product marketed by Philadelphia Quartz Company, Philadelphia 6, Pa., USA) as the hydrophilic solid substance. The copy produced was similar to that produced in Example 1.

EXAMPLE 4

The procedure described in the preceding example was repeated, except that a thin layer of polytetrahydroperfluoro alkyl acrylate was previously applied to the photoconductor in order to further increase its hydrophobic properties. A good image of the original was thus produced.

EXAMPLE 5

The procedure described in Example 1 was repeated, with the following variations: The hydrophilic solid substance used for pre-development was the already described precipitated silica, which, in this case, had been treated with 0.1 percent of "Sapogenat" (a commercial product marketed by Farbwerke Hoechst A. G., Frankfurt/M., Germany). The wetting solution was a 0.1 percent solution of methylene blue. In this case, too, a good image of the original was obtained.

EXAMPLE 6

An image was produced on the photoconductor as described in Example 1 and pre-developed with methylene blue as the hydrophilic solid substance. 1% of dyestuff was contained in the developer mixture of the magnet brush. For wetting, water was sprayed onto the developed image. The image of the original thus produced was of good quality, but showed a scum in the form of tiny blue dots.

EXAMPLE 7

The method described in the preceding example was repeated, using 0.5% of nigrosin in the developer mixture of the magnet brush. An image of the original was obtained which, although usable, was inferior in quality to the image obtained according to the preceding example.

EXAMPLE 8

The procedure described in the preceding example was repeated, using 0.5 percent of acid violet as the hydrophilic solid substance. The copy produced did not quite reach the quality of the copy produced when using methylene blue.

EXAMPLE 9

The procedure described in Example 1 was repeated. The hydrophilic solid substance used was the above described silica "Quso H 40" which, in this case, had been treated with 150% of "Methylene Blue BB" and 1% of "Sapogenat T 130". The image was wetted with water sprayed from a spray gun. Upon transfer, a satisfactory image of the original was obtained. The high concentration of dyestuff necessary for producing the image is presumably due to the large interior surface of the precipitated silica, which causes the dyestuff to be released by the silica only at a very high concentration.

EXAMPLE 10

A crystal violet solution was used as already described, but pre-development was performed by means of a developer mixture consisting of 1 g of water-insoluble starch and 100 g of iron filings. A copy of good quality resulted.

All percentages disclosed are by weight unless otherwise indicated.

What is claimed is:

1. A process of forming an electrophotographic copy from an original which comprises uniformly charging a photoconductive hydrophobic material by means of a corona, image-wise exposing the photoconductive hydrophobic material in an exposure station, pre-developing the exposed charge image to a hydrophilic image by means of a two-component developer powder consisting of a hydrophilic solid substance and a carrier material, developing the hydrophilic image with an aqueous liquid into an aqueous image and transferring the aqueous image thus produced onto a copy receiving material.

2. The process according to claim 1, wherein the hydrophilic solid substance is a pigment.

3. The process according to claim 2, wherein the pigment is selected from the group consisting of water-insoluble starch, silica, iron-III-oxide and zinc oxide.

4. The process according to claim 1, wherein the hydrophilic solid substance is a water-soluble dyestuff.

5. The process according to claim 4, wherein the water-soluble dyestuff is selected from the group consisting of methylene blue, nigrosin and acid violet.

6. The process according to claim 4, wherein the aqueous liquid is water.

7. The process according to claim 1, wherein the hydrophilic solid substance is precipitated silica.

8. The process according to claim 7, wherein the precipitated silica contains a considerable quantity of a dyestuff.

9. The process according to claim 8, wherein at least 150% of methylene blue is present in the precipitated silica, based upon the amount of silica.

10. The process according to claim 1, wherein the hydrophobic material is an organic photoconductor.

11. The process according to claim 10, wherein the organic photoconductor is a charge transfer complex of polyvinyl carbazole and trinitrofluorenone.

12. The process according to claim 10 wherein the organic photoconductor is provided with a coating of a strongly hydrophobic material.

13. The process according to claim 12 wherein the strongly hydrophobic material is selected from the group consisting of polymethyl siloxane and polymeric fluorinated hydrocarbons.

14. The process according to claim 1, wherein the pre-developing is effected with a magnet brush and the hydrophilic solid substance contains iron filings.

15. The process according to claim 12, wherein the pre-developing is effected with a magnet brush and the hydrophilic solid substance contains iron filings.

* * * * *